United States Patent [19]

Ries et al.

[11] 4,272,365

[45] Jun. 9, 1981

[54] MAGNETIC SEPARATOR

[75] Inventors: Guenter Ries; Klaus-Peter Juengst; Siegfried Foerster; Franz Graf, all of Karlsruhe; Wolfgang Lehmann, Leopoldshafen; Karl-Heinz Unkelbach; Gottfried Duren, both of Cologne, all of Fed. Rep. of Germany

[73] Assignee: Klöckner-Humboldt-Deutz AG, Fed. Rep. of Germany

[21] Appl. No.: 9,291

[22] Filed: Feb. 5, 1979

Related U.S. Application Data

[63] Continuation of Ser. No. 843,737, Oct. 19, 1977, abandoned.

[30] Foreign Application Priority Data

Nov. 4, 1976 [DE] Fed. Rep. of Germany ..... 2650528

[51] Int. Cl.[3] ..... B03C 1/14

[52] U.S. Cl. ..... 209/223 R; 335/299

[58] Field of Search ..... 209/223 R, 223 A, 212, 209/222, 219; 335/299, 227; 210/222, 223

[56] References Cited

U.S. PATENT DOCUMENTS

| | | | |
|---|---|---|---|
| 463,305 | 11/1891 | Hoffman | 209/223 A X |
| 679,100 | 7/1901 | Allen | 209/223 R |
| 971,163 | 9/1910 | Wood | 209/223 X |
| 1,371,301 | 3/1921 | Converse | 209/219 |
| 1,414,170 | 4/1922 | Bothke | 209/223 A X |
| 3,168,464 | 2/1965 | Ferris | 209/232 X |
| 3,281,737 | 10/1966 | Swartz | 335/299 X |
| 3,503,504 | 3/1970 | Bannister | 209/223 R |
| 3,892,658 | 7/1975 | Bendnitz | 209/223 A X |
| 3,935,095 | 7/1976 | Susse | 209/222 |
| 4,003,830 | 1/1977 | Schloenynn | 209/212 |

FOREIGN PATENT DOCUMENTS

| | | | |
|---|---|---|---|
| 27102 | 6/1930 | Australia | 209/219 |
| 830931 | 2/1952 | Fed. Rep. of Germany | 209/223 A |
| 845331 | 6/1952 | Fed. Rep. of Germany | 209/223 R |
| 2157217 | 11/1971 | Fed. Rep. of Germany | 209/223 R |
| 637790 | 2/1928 | France | 209/219 |
| 426705 | 7/1972 | U.S.S.R. | 209/223 R |

*Primary Examiner*—Robert Halper

*Attorney, Agent, or Firm*—Hill, Van Santen, Steadman, Chiara & Simpson

[57] ABSTRACT

A magnetic separator, in particular a drum separator, includes a magnetic system having a plurality of magnets. Each of the magnets produces an open field directed toward a separation zone which, in a drum separator, extends axially of the drum outside of the surface of the drum. The magnets may include conductive coils, preferably superconducting coils, which are traversed in the same direction by current and which include an iron-free core. The average center-to-center spacing of the coils is a maximum of 25 times the spacing between the coils and the separating zone and is preferably in the range of 15:1 to 10:1. The coils are elliptical and have major and minor axes which decrease from the outermost coil winding to the innermost coil winding, with the distances between the windings being greater along the major axes than along the minor axes.

4 Claims, 5 Drawing Figures

OPEN MAGNET SYSTEM

MAGNETIC SEPARATOR

This is a continuation of application Ser. No. 843,737, filed Oct. 19, 1977, now abandoned.

BACKGROUND OF THE INVENTION

1. Field of the Invention

This invention relates to a magnetic separator for the separation of magnetizable and non-magnetizable particles in a magnetically circulated separating zone, whereby the magnetic field produced by several magnets or magnet systems extends into a magnetically open field in the direction of the separating zone.

2. Description of the Prior Art

A characteristic feature of the magnetic system of a magnetic separator is its extent of its lines of flux. Open and closed types of construction are different, with respect to the extent of the lines of flux. In the closed type of construction, the separating zone is arranged between the opposite poles or pole shoes of one or more magnets. With this arrangement, a magnetic field is developed which has short free lines of flux from one pole to the other which extend transversely through the separating zone. This construction is preferred for high intensity magnetic separators in that it permits a concentration of the magnetic field to the narrowest space and attainment of a very high field intensity. By arranging the magnetic poles opposite one another, the lines of flux extend along the shortest direct path from one pole to the other. In contrast thereto, the poles of a magnetic separator of an open magnetic system lie substantially adjacent one another so that the lines of flux from one pole to the other must travel curved paths through the space adjacent the poles. The lines of flux extend into an open field adjacent the poles, whereby the magnetic field intensity strongly decreases perpendicularly to the pole surface.

SUMMARY OF THE INVENTION

The present invention is concerned with construction of a magnetic separator of the open system type as generally set forth above.

It is the object of the invention to improve magnetic separators of the open system type and, in addition, to afford the possibility of an increase in output of the open system.

By means of the technical development of method and processes, as for example, direct reduction, it has become necessary, in order to obtain high-grade Fe-concentrates with the least impurities, to undertake a still further-going comminution than heretofore obtained, which frees and isolates the mineral components to as great an extent as possible. Therefore, there results large streams of volume of the finest particles, which must be magnetically prepared and which make necessary magnetic separators having large operating scope and operating chambers. Large operating chambers again require magnetic fields of great extent for pick-up of the particles to be prepared.

The problem is solved and the above object is achieved, according to the present invention, in that the magnets or magnetic systems which produce the open field of the separating zone are arranged alike. Through the arrangement, according to the present invention, there results an open field, in contrast to previous arrangements in which the magnetic lines of flux extend between the adjacently disposed poles, but in which, between the individual magnets or magnetic systems, counterpoles are constructed or developed which lead to a larger magnetic flux at a similar magnet or magnetic system expense. This has the result of an increase in the magnetic forces. Advantageously, through the spacing and the construction of the individual magnets or magnetic systems, a special line of flux development may be obtained, which compared with a comparable arrangement on the surface of the magnets or magnetic systems has a lower gradient, at greater spacing, however, a greater gradient, so that particularly large operating chambers may be filled out with a magnetic field. Accordingly, in reference to the gradients, the magnetic field obtained in practicing the present invention is provided by advantageous construction not previously attainable. This construction of the gradients has as a result a uniformity in the magnetic separation of open separators, not heretofore attainable, so that also the highest requirements as to quality may be fulfilled.

In one embodiment of the invention, it is provided that the magnetic systems are formed of conductive coils traversed by current, the current flowing in the same direction through the coils. Hereby, the arrangement of the magnetic systems in the same direction is simply and advantageously attained.

Furthermore, it is provided that the conductive coils, are traversed by current in the same direction. Inasmuch as a weakly magnetic (magnetically soft) iron core functions essentially as an air core in response to high magnetic fields the same will hereinafter be referred to as iron-free, although the iron does physically support the coil. Through this measure, it is possible to attain a flux line construction which is not attainable with individual poles whose iron core guides the lines of flux.

In a further advantageous embodiment of the invention, it is provided that the separating zone is arranged spaced from the surface of the magnets or magnetic systems in the open field. This results in a particularly accessible embodiment of a magnetic separating chamber, in which additionally the chamber between the separating zone and the surface of the magnets or magnetic systems may be utilized for the accommodation of a transporting means, an insulation, or a guide element, without thereby negatively influencing the uniform magnetic separator field of the invention from being developed.

In this connection, it is provided that the center-to-center spacing (L) of the individual magnets or magnetic systems is approximately 25 times greater from one another than the distance ($Z_o$) of the separating zone from the surface of the magnets or magnetic systems, and particularly lies in the area between 15:1 and 10:1. The indicated ratios result on the basis of optimizing calculations, which indicate, as especially favorable, the area by the factor $4\pi$ between the two distances: ($L \approx 4\pi\ Z_o$), and lead particularly for the very strong magnetic field of over 20 kilogauss utilized in the magnetic separation at the time, to a field particularly suitable for the magnetic separation of finer and finest particles, the field combining the great range with great gradients, i.e. separating forces.

In another embodiment of the invention, it is furthermore provided, that the conductive coils which are traversed by current in the same direction, are constructed as superconducting coils. Through this measure, there results particularly for large volume currents a possibility for the production of sufficiently strong magnetic fields without having to increase too greatly and to raise the cost of the appertaining magnetic apparatus. In this connection, it is especially advantageous that through the selected dimensions between the separating zone and the surface of the magnetic system, an intermediary chamber or space is available, which may be utilized for the insulation of the superconducting magnetic system, so that losses in cold (heat transfer) are decreased to a tolerable degree and one of the most essential obstacles for the utilization of the superconduction in magnetic separator construction is eliminated.

In another development of the invention, it is furthermore provided that the magnets or magnetic systems are embedded in a weakly-magnetic mold part which functions as a support. This results in an advantageous magnetic exchange effect between the magnets or magnetic systems utilized and the support body in which the individual elements are embedded, in such a manner that they fix themselves in the support itself. This is particularly important with the magnetic system of the present invention, as the individual poles repel one another with appreciable forces and a mounting in a curved surface would otherwise lead to appreciable constructive expenditure for the installation.

In a further embodiment of the invention, it is provided that the conductive coils have windings which are constructed in elliptical or race-track form. With such construction it is advantageously possible, particularly when the coil length corresponds to the width of the work chamber, to obtain through the entire width of the work chamber a uniform magnetic field with respect to the particular change in field strength, so that each particle of ore, regardless of where it passes through the separating zone, will be subjected to the same magnetic forces as all other particles. The utilization of such extended magnetic coils was heretofore known in the magnetic suspension technique. In that technique, the sole purpose was to decrease the number of required magnetic systems or poles, while the present invention has another object for this aspect of the invention, namely insuring a uniformity of field and the magnetic gradients occurring therein.

In an advantageous construction of the coils, it is provided that the windings of the conductive coils at the narrow ends have larger spacings between the individual conductors than on the longitudinal sides thereof. Through this measure, an undesired punctual amplification of the magnetic field at the ends is prevented, and a uniform magnetic field is attained over the entire coil length. The size of the fanning of the conductor at its ends is thus dependent upon the coil geometry.

For the construction of a magnetic separator in accordance with the invention it is provided that the magnetic separator be formed as a drum separator, whereby the elliptical or race-track coils extend in their longitudinal direction in the direction of the axis of the drum. In this manner, a particularly favorable embodiment of a drum separator is obtained having similar separating forces for all the particles passing through the separating zone, when the material is guided in the direction of the circumferential lines of the drum. In the case where the material is guided parallel to the axis of the drum, similar to a crossing-band separator, there results, with an arrangement constructed in accordance with the present invention, further advantages in that a differentiating deflection of weakly and strongly magnetizable particlesfrom the feed direction is attained so that a separation of the different types of gangue—weakly, average and strongly magnetizable—is made possible with simple means.

It is furthermore provided that the coils are curved in the direction of the drum surface and that the lengths of the axes of the coils decrease from the outer windings to the inner windings. In this manner there results an advantageous spatial adaptation of the magnetic systems to the geometry of the drum, which furnishes the same conditions over all for the separating chamber and at the same time makes possible the installation of coils of greater length, although the spatial conditions in the interior of the drum are limited.

In a further development of the invention, it is provided that the weakly-magnetic coil support is constructed as a plane element and that the same is pivotally mounted so as to be adjustably swingable with reference to the horizontal. With this construction an advantageous application of the principles of the invention is made possible for separators of great length of feed-through and long duration of the particles to be prepared with adjustment of the most varied conditions of speed, so that an adaptation to all requirements of the preparation technique may take place.

The utilization of equidirectionally directed magnetic poles in a drum for the magnetic separation is already known from the German Pat. No. 919,641. In this connection it is, however, not a question as a prerequisite for the invention, of an open system, but of a closed magnetic system, in which the particular drum surface acts as an individual pole and is in effective connection with an oppositely disposed otherwise poled drum correspondingly connected with magnetic yokes. The principle of the present invention is not approached by the system disclosed in this German patent.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
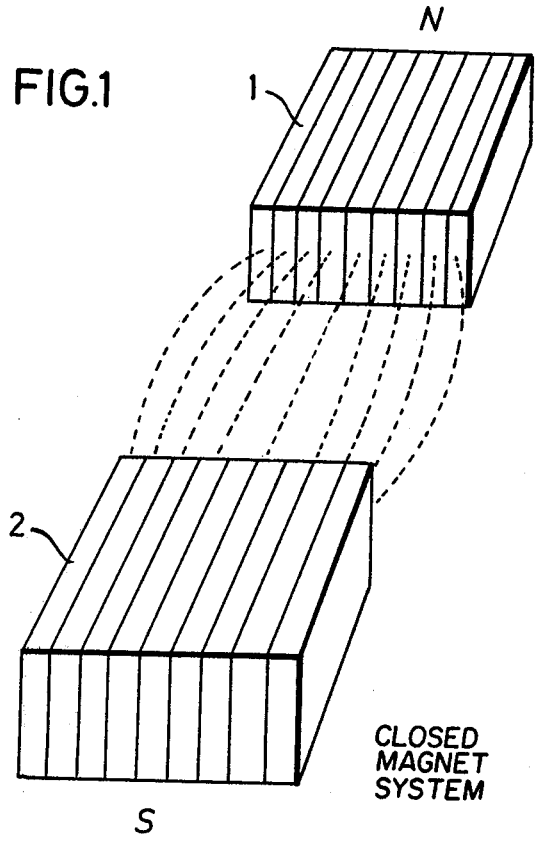
FIG. 1 is a diagrammatic representation of the extent of lines of flux of a closed magnetic system, shown in a perspective view.
Figure 2:
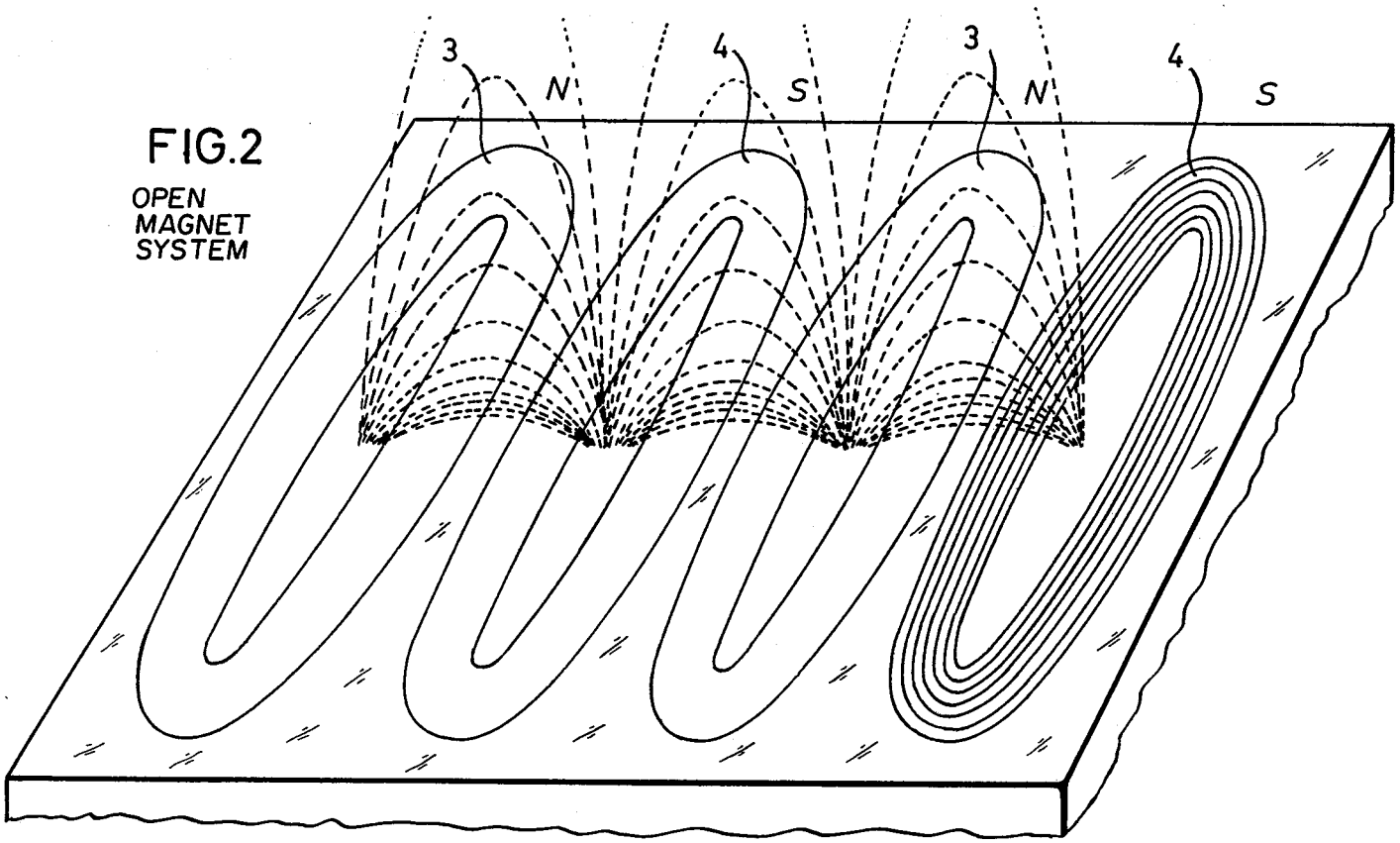
FIG. 2 is a diagrammatic illustration of the extent of lines of flux of an open magnetic system, also illustrated in a perspective view.
Figure 3:
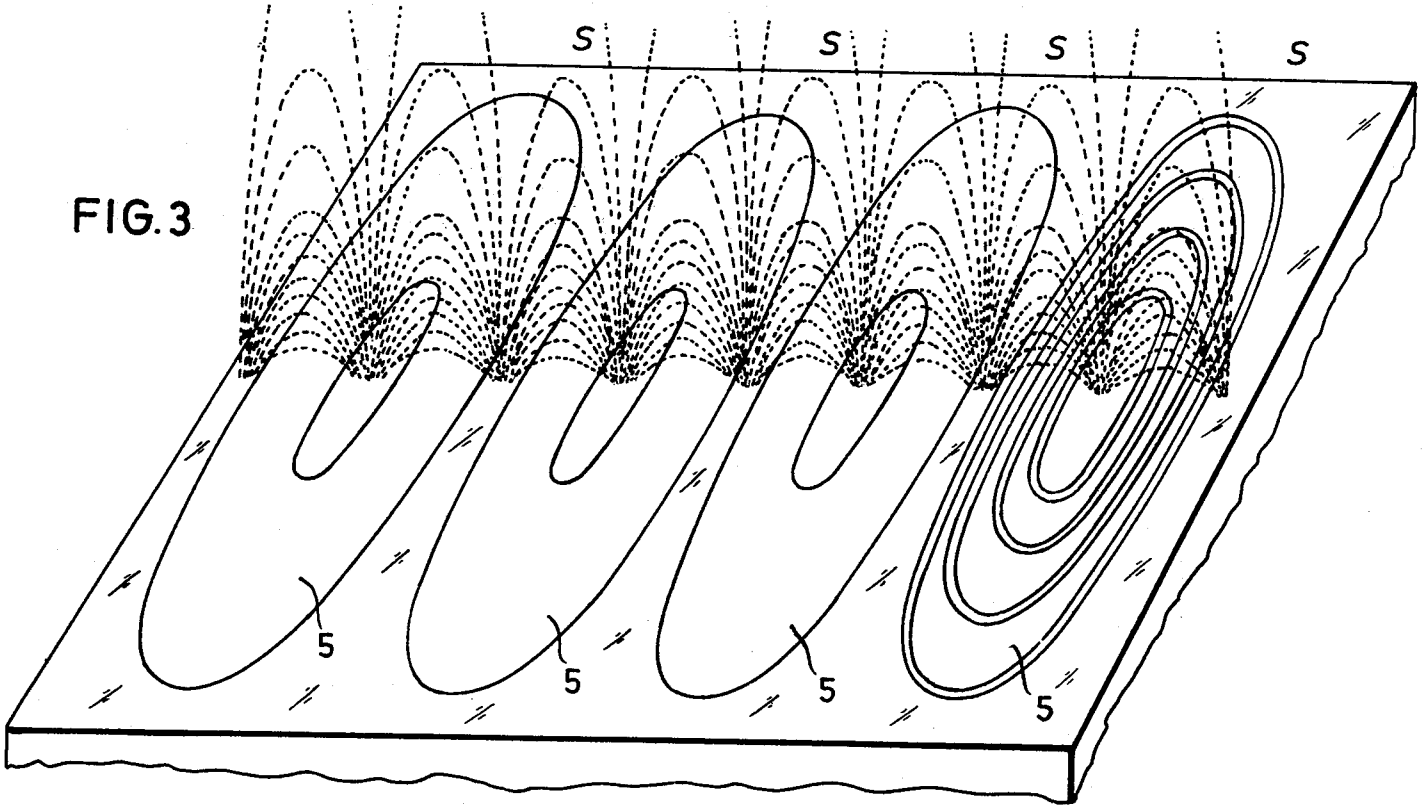
FIG. 3 is a diagrammatic illustration of the extent of lines of flux of an open iron-free system constructed in accordance with the invention.

The different magnetic systems of FIGS. 1, 2 and 3 are illustrated to diagrammatically show the extent of the lines of flux in those systems.

In FIG. 1, for example, a magnet system is provided by the elements 1 and 2 to develop a north pole N and a south pole S. Lines of flux extend between the north and south poles, all of the lines being closed directly between the poles and there is little transverse magnetic spreading. The field is uniform if one ignores the disturbances at the edges. This pole arrangement, narrowing the lines of flux on one side, illustrates the principle of the closed magnetic separator, which advantageously is used for strong field (high intensity) magnetic separators.

Referring to FIG. 2, the normal construction of an open magnetic system is apparent, the drawing giving an example over several extended poles. A north pole 3 and a south pole 4 are arranged alternately adjacent one another, and the lines of flux extend along curved paths from one pole to the adjacently disposed pole. An appreciable portion of the lines of flux extends into the free half-chamber or space above the pole plane. In the space perpendicular to the pole surface, great differences in field strength are apparent. Magnetic particles passing through this field at different spaces are differently magnetized. The only practical utilizable space is directly above the pole surface.

FIG. 3 illustrates a magnetic separator system constructed in accordance with the invention, an example being given of several iron-free elliptical or race-track conductive coils. The conductive coils 5, arranged adjacent one another, produce lines of flux, with which the same coefficient of poles extend appreciably more compactly and are less deflected than in the previously illustrated conventional open systems. In connection with the extended magnetic coils and optimal spacings, according to the present invention, there results a uniform field with a particularly favorable separator effect and great range. The counterpoles are particularly noticeable when compared to the coil arrangement of FIG. 2.

Figure 4:
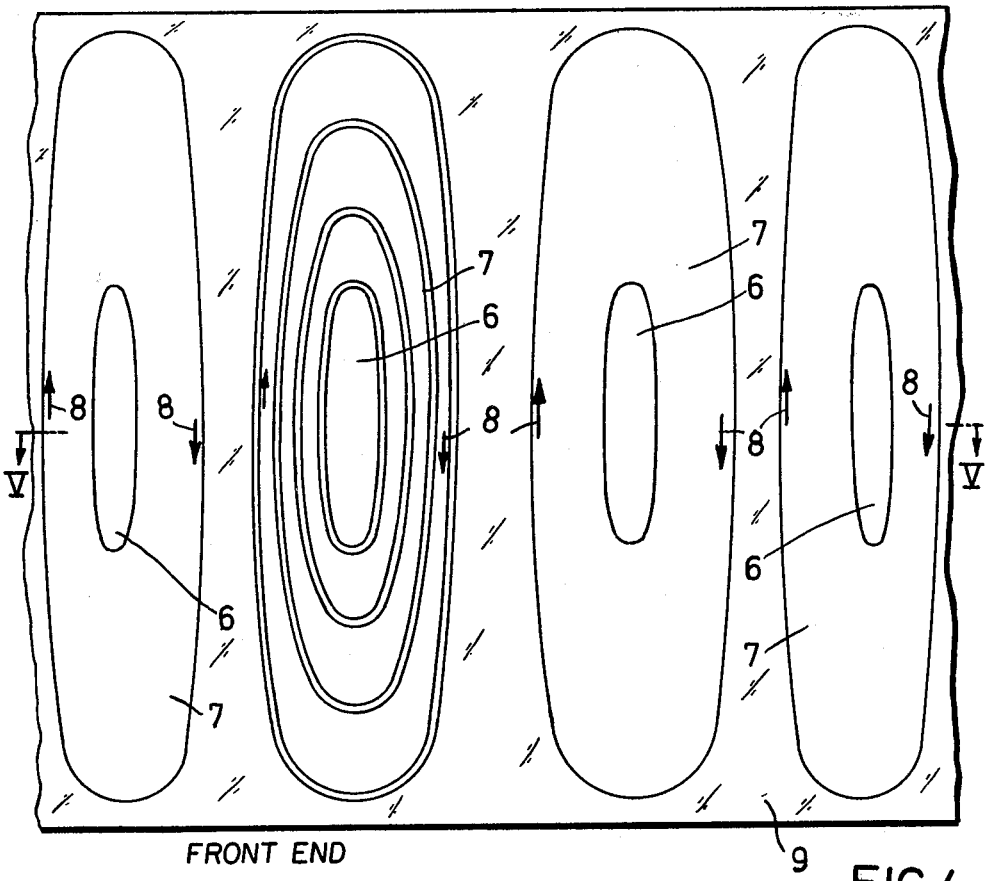
FIG. 4 is a plan view of the coil arrangement of the present invention in the segment of a drum as seen from the top.

FIG. 4 illustrates the construction of a magnetic system, according to the present invention, in a drum separator in a top view on the drum. The drum has adjacently disposed slightly elliptical magnetic coils 7, which are wound about a weakly magnetic iron-free drum part 6. Through the current direction arrows 8 it is apparent that all coils lying adjacent one another act in the same direction. The coils are embedded in the weakly magnetic part 9, so that in spite of the curvature and the appreciable repelling forces taking effect between the coils, according to the principle of the magnetic mirror effect, they are fixed in the drum and a separate fastening which may occur is not necessary.

Figure 5:
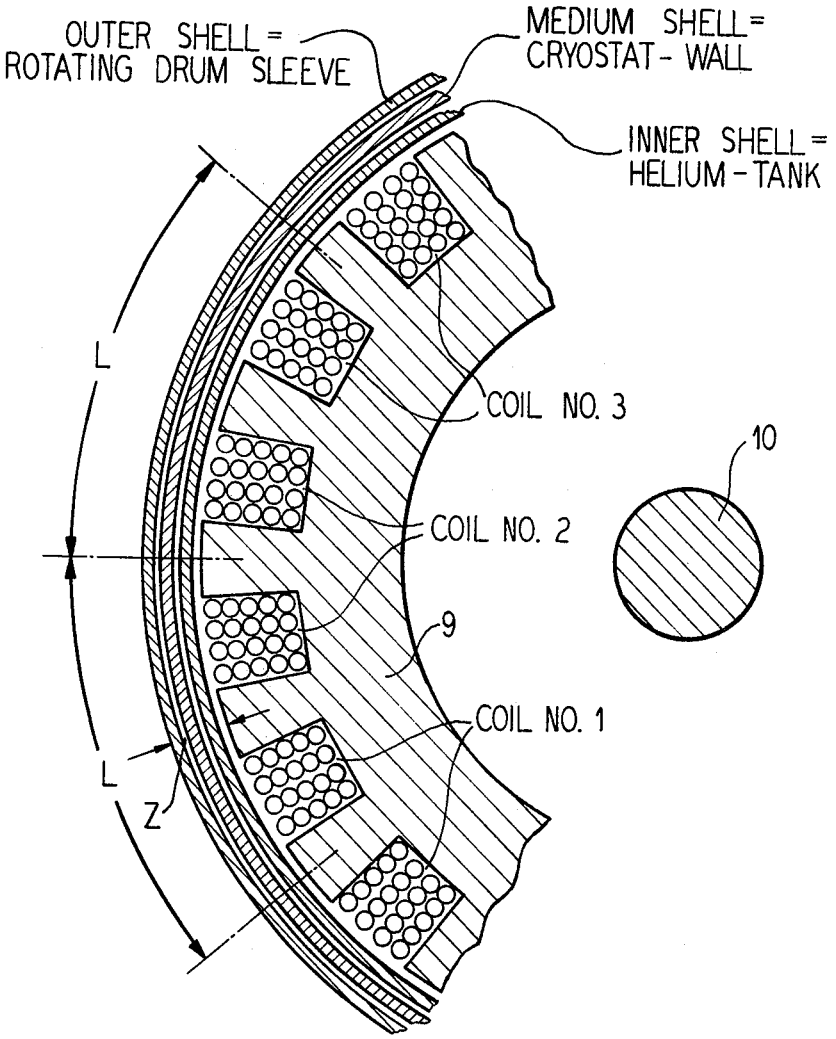
FIG. 5 is a fragmentary sectional view of the coil arrangement taken generally along the line V—V of FIG. 4.

FIG. 5 illustrates a cross-sectional view taken through the magnetic coils along the line V—V of FIG. 4. The magnetic coils 7 are tapered, in the direction of the axis of rotation 10 of the drum. The length of the coils corresponds to the axial length of the drum. In this manner, it is possible to make optimum use of the interior of the drum and, in spite of the coil arrangement, unfavorable in itself, which results through the arrangement of the coil axis perpendicular to the axis of the drum, to produce a very large field strength. The superconducting coils make possible great field strengths even in the case of small dimensions. In such a case, the coils are embedded in a support, as illustrated in FIG. 3, for disposition within the drum. It should be pointed out, also, that the drum may have an outer rotatable sleeve which is not the peripheral surface illustrated in FIG. 5, but which would surround the structure illustrated in FIG. 5.

The arrangement of the conductive coils of the present invention in a planar plate, which is constructed for pivotal movement about a horizontal axis is not illustrated, as it corresponds to the drum surface illustrated in FIG. 4. Only the eventual diminution of the axes of the coils is missing, as with this construction no problems as to space occur.

The application of the invention is not limited to the above-mentioned examples, but is generally possible in the magnetic separator technique. Therefore, for example, weak field separators in the laboratory scale is just as possible with permanent magnets, as large, high intensity magnetic field separators having super-conducting coils. In all cases of use, the positive results brought about by means of the uniformly separating field occur. As the principle of the present invention is not limited to the utilization in high intensity separators, it is also utilizable in iron-free separators. Together with suitable formed separator-chamber installations, there result a plurality of advantageous effects not described herein in detail.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In the magnetic separator of the type which has a separating zone for the separation of magnetic and non-magnetic materials fed into the zone and in which a drum sleeve rotates through the separating zone and rotates about a magnet system for flooding the separating zone with a magnetic field, the improvement wherein:

said magnet system comprises a plurality of superconducting coils adjacent one another and wound synonymously and adapted to carry current in the same direction, said magnetic coils being of synonymous polarity and producing a high intensity magnetic field which is open in the direction of the separating zone, and soft iron, said coils embedded in said soft iron and operating in an iron-free manner.

2. The improved magnetic separator of claim 1, the improvement further defined wherein:

said coils including elliptically-shaped windings which are spaced apart, in the direction of the major axes of the ellipses, greater distances than the spacing of said windings in the direction of the minor axes of the ellipses.

3. The improved magnetic separator of claim 1, the improvement further defined wherein:

the drum magnet system is spaced from the separating zone a predetermined distance; and the center-to-center spacing of adjacent coils is no greater than 25 times said predetermined distance.

4. The improved magnetic separator of claim 3, wherein said spacing is preferably 10 to 15 times said predetermined distance.

* * * * *